United States Patent [19]

Laciste

[11] 4,146,228

[45] Mar. 27, 1979

[54] SLIDING COUNTER GAME BOARD WITH ARCUATE PERIPHERAL WALLS

[76] Inventor: Benflor A. Laciste, 853 N. Viceroy, Covina, Calif. 91723

[21] Appl. No.: 722,866

[22] Filed: Sep. 13, 1976

[51] Int. Cl.[2] ..... A63F 3/00

[52] U.S. Cl. ..... 273/126 R

[58] Field of Search ..... 273/119 R, 126 R, 126 A, 273/2, 3 B, 3 A, 85 R, 8, 9, 12, 85

[56] References Cited

U.S. PATENT DOCUMENTS

| | | | |
|---|---|---|---|
| 445,626 | 2/1891 | Cogswell et al. | 273/126 R |
| 747,716 | 12/1903 | How | 273/8 |
| 800,232 | 9/1905 | McCluskey | 273/126 R |
| 1,512,442 | 10/1924 | Arnold | 273/126 R |
| 2,344,737 | 3/1944 | Schlesinger | 273/126 R |
| 2,585,458 | 2/1952 | Gordon | 273/126 R |
| 3,029,078 | 4/1962 | Frigo | 273/3 A |
| 3,463,489 | 8/1969 | Tretow | 273/3 R |
| 3,544,108 | 12/1970 | Bail | 273/8 |

FOREIGN PATENT DOCUMENTS

| | | | |
|---|---|---|---|
| 391899 | 5/1933 | United Kingdom | 273/126 R |

*Primary Examiner*—William H. Grieb
*Assistant Examiner*—T. Brown
*Attorney, Agent, or Firm*—Boniard I. Brown

[57] ABSTRACT

A substantially square game board is provided with a smooth horizontal surface, concavety arced peripheral walls and pendant pockets at the four corners. A plurality of counters in the form of circular disks is slideable upon the surface of the board and may be set into motion by a puck impelled by the action of a cue stick. Each of the counters bears a different numeral, and it is the purpose of the game for each of the participants to direct such of the counters into a pocket as would add up to a predetermined numerical goal. The goal is selected by the choice of a numbered marble by each player prior to the start of the game. The first player to achieve a total exactly matching the numeral on his chosen marble is the winner.

9 Claims, 5 Drawing Figures

SLIDING COUNTER GAME BOARD WITH ARCUATE PERIPHERAL WALLS

BACKGROUND OF THE DISCLOSURE

The invention relates to games played with numbered counters slideable on a horizontal game board. It relates, more particularly to such games, wherein such counters may be entrapped in pockets at the corners of the game board, for purposes of scoring.

Many games are known in the prior art in which counters or balls marked with numerals are propelled across the surface of a game board with the aim of 'pocketing' such playing pieces in traps provided at suitable locations, commonly the corners, of the board. The common games of billiards fall into this category.

There are also games of skill in which players are required to attain some matching of numbers for a predetermined total score which may be different for each player; darts fall into this category.

Both of the above classes of games are marked by a requirement for the skill of the player to place or propel his counters, darts, balls or other game pieces to the desired destination and to attain some goal before any of the other players. To some extent this constitutes a defect for games that are to be played by family groups or other players selected at random, without reference to individual skill, since the expertise of the respective players will predetermine the outcome of the game.

It is, therefore, a primary object of the invention to teach the construction of game apparatus which retains the advantages and interest inherent in the aforementioned classes of games, and also introduces elements of chance which tend toward equalizing the opportunities of the several players varying in age and skill.

It is a further object of the invention to provide game apparatus which is compact in nature and readily adapted to installation and use in the confined spaces of the average home.

It is also an object of the invention to provide a game in which the several players, while pitted against each other, are also playing towards a goal unknown to the other players.

SUMMARY OF THE INVENTION

The above advantages and objects are attained in a game apparatus based on a board whose general appearance and size approximate that of the common card table. The board is formed of a number of equal sides arranged in a regular polygon; most commonly a square, pentagon or hexagon. At each vertex of the board a pocket is provided, capable of entrapping round counter disks which can be easily propelled across the surface of the game board.

To prevent the counter disks from leaving the game board surface, and also to provide boundaries from which they can carom off and change direction, the edge of the board is provided with a raised border. Unlike the border of a pool table, which is straight so that balls will bounce off in predictable directions, the raised border of the instant game is arcuate with a radius of curvature relatively large, compared to the mean radius of the gameboard surface. The curvature of the border is concave, as viewed from the center of the board. The arcing of the edges of the board reduces the advantage possessed by those players who may be expert at billiards and able to predict accurately the rebound angle from a linear boundary.

The counter disks are numerous, twenty to thirty in number, and marked with individual and different numerals. In a preferred embodiment of the game their number is twenty-eight and they are marked with the numerals from one through twenty-eight consecutively. The individual players do not propel the counter disks manually, but through the agency of two additional game components, a cue stick and a puck.

The requirement that the counter disks be moved by impact of the puck, and that the puck is to be impelled by the cue, in the manner of a billiard ball, introduces additional uncertainties into the trajectories of the counter disks, and reduce win probabilities based on skill. An element of calculation is introduced into the rules of the game by a feature similar to that employed in darts. Each player draws, by the operation of chance, a goal in the form of a ball, marble, or card, with a numeral on it. It then becomes his task to place such counters in the pockets of the game boards whose markings add up to the numeral on his personal card.

Since each player will attempt to keep his own desired total score secret, so that the opponents will not at some critical junction 'steal' the only marker still in play which is suitable to complete his score, and will simultaneously attempt to guess which markers others are playing for, tactical considerations are introduced with transcend mere mechanical skill and which render the game much more interesting.

In one variant of the game the gameboard is provided with a central zone, preferable circular in outline, which serves a special purpose (beyond that of an initial starting area from which the individual markers are 'broken' by the first player) as a penalty zone. It is provided in the rules, where one player has a strong suspicion that another player is overly interested in a particular marker, that this first, player may drive the marker into a pocket and, instead of crediting the score to his own total, remove it again and place it back into the center zone. To make this play a little harder it is also possible to include a rule that a marker may be only put back into play if the driving puck is pocketed on the same stroke.

It is possible to provide the game board with a single cue passed around the table from player to player as the game proceeds. It is more convenient to provide as many cues as players are contemplated and, also, to mount the game board on a central pivot, in the manner of a Lazy Susan, so that each player can remain in position and turn the table to select the best line of action for his stroke.

The constituent components of the game apparatus, and the manner in which they are employed to play a typical game, will be described below with reference to drawings of a preferred embodiment of the invention. These drawings include:

FIG. 1, a perspective view of a game board of the invention, with four equal-length sides and four pockets at the vertices of the board, as well as a typical cue and a jar for selecting marbles with the goal scores of the several players;

FIG. 2, a partial transverse section through the game board of FIG. 1, taken along section line 2—2 in that Figure, illustrating the construction of the pivot mechanism and the structure of the pockets;

FIG. 3, a perspective view of the drive puck and of the numbered counter disks through which the game is scored;

FIG. 4, a schematic illustration of the numbered goal markers or marbles for establishing the goal scores of the several players prior to the beginning of the game proper; and FIG. 5, a partial view of a typical game scoring sheet with the notations of the scores accruing to two players and their relationship to the goals established by the goal markers.

DESCRIPTION OF THE PREFERRED EMBODIMENT

Figure 1:
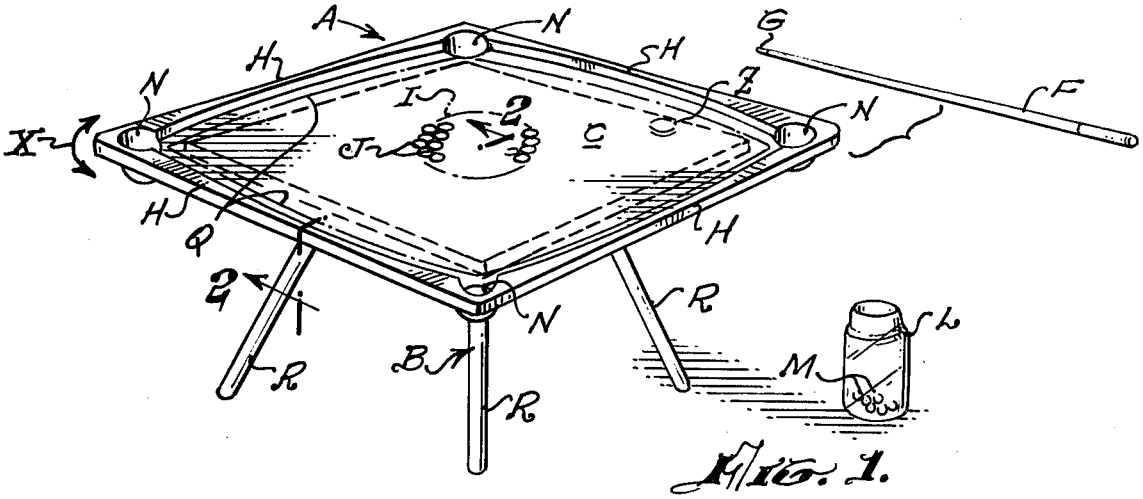

FIG. 1 is a perspective view of a gameboard A of the invention mounted upon a support table B and centrally pivoted with respect to the Table B, being free to rotate in the sense of arrow X. The gameboard A is defined by a horizontal surface C and peripheral sidewalls H, interrupted at the corners by Pockets N. In the embodiment of FIG. 1 the surface C is substantially square with the sidewalls H bowed outwardly between the corner pockets N to form concave rebound walls or fences when viewed from the center of the board. A line Q is marked on the playing surface C some two inches from the sidewalls H and parallel thereto; this line demarcates the position to which a player may move a large puck Z, whose function and dimensions will be more fully described below. A central circular area is also demarcated in the playing surface, at I. The diameter of this area, as defined by the circle I, is approximately one-fourth to one-fifth the diagonal dimension of the gameboard.

At the beginning of the play a large number of flat counter disks J, round in plan, are placed into the central area inside I, and are broken by the acceleration of puck Z toward them, through the agency of a cue stick F. The cue F is similar to the driving appliance employed in billiards, bumper pool and other games; it is, preferably, provided with a rubber tip G, to reduce the bounce of the struck puck.

Players attempt, by skillful playing of the cue stick, to direct individual counter disks J toward the corner pockets N, by causing the puck Z to impact upon the selected counter. Each of the counter disks 3 is marked with a different numeral, and, once pocketed, taken out of the game. It is the players' goal to drop into the pockets of the gameboard A such counters whose markings add up to a numerical value equal to a preselected goal mark according to the number on the goal marker or marble drawn by that player as hereinafter described. In the view of FIG. 1 a jar L is shown with a number of goal marker marbles placed therein. Each of the marbles M is marked with a number corresponding to a realistic goal for one player. At the beginning of the game each player draws one goal marker marble from the jar L and, thus, establishes his personal goal score. It is advisable to keep this goal secret from the other players, lest they remove from play some counter disk crucial to the first player securing his exact score.

Figure 2:
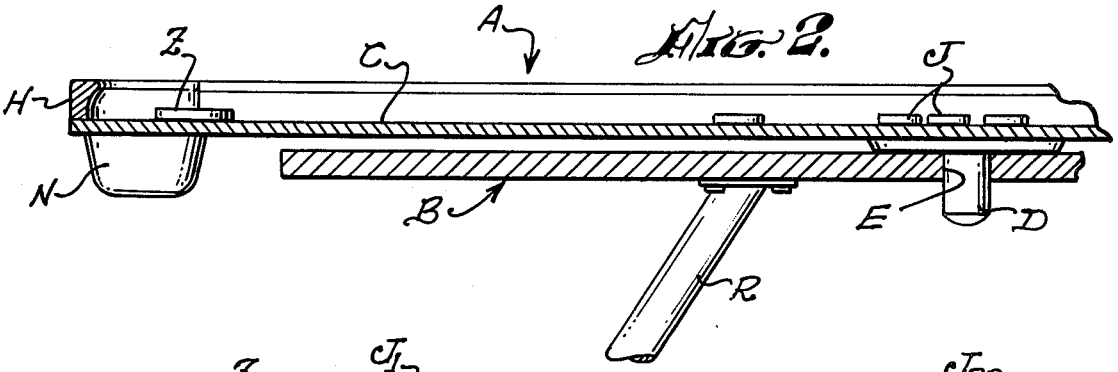

FIG. 2 is a partial transverse section through the embodiment of FIG. 1, tkaen along section line 2—2. The table B supports the gameboard A in a socket E adapted to receive a pivot pin D attached to, and depending from the geometric center of, the gameboard. The table B incorporates legs, suitably four in number, with a typical leg identified at R in FIG. 2.

The illustration also shows a typical pocket N and the manner in which the peripheral walls H of the gameboard encompass the outer perimeter of the pocket, so that a counter aimed at the pocket with a substantial momentum would be deflected downwardly into the declivity of the pocket and prevented from escaping the playing surface.

Figure 3:
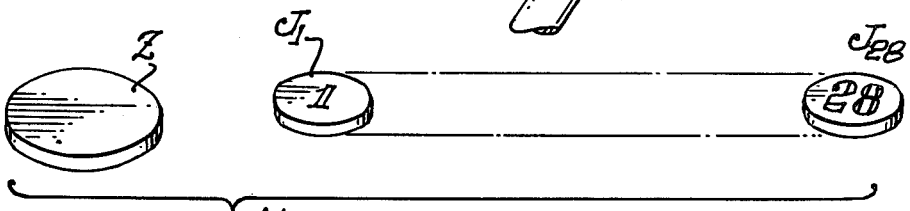

FIG. 3 is a representation of the drive puck Z and of the counter disks J, showing the simple shape of these components. The disks J are suitable 2 inches in diameter and approximately 5/16ths thick, while the puck is larger, at a diametral dimension of some three inches. These parts are suitably manufactured out of a rigid plastic and the weight of the puck is approximately 125% of the weight of a silver dollar, or near 1 and $\frac{1}{3}$ ounce. The disks are twenty-eight in number and are marked with numerals going consecutively from one to 28.

Figure 4:
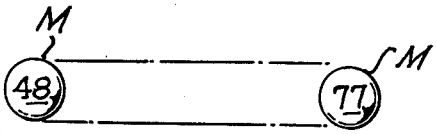

FIG. 4 is an illustration of the goal marker or marbles M used to predetermine the players' goal scores. A sufficient number must be provided, fourteen in the present instance, to cover the most probable sums attainable with a reasonable number of counter disks. For the same reason the values inscribed in their surfaces must be carefully chosen to represent a fair sampling on the probable combinations, must be different from each other yet represent roughly the same number of counter disks, so that a player would not receive undue advantage from having chosen a particular marble M from the jar L. The fourteen marbles of the preferred embodiment are numbered with the numerals: 48, 50, 52, 54, 57, 62, 63, 64, 66, 70, 72, 73, 75 and 77. These sums can be generally attained with the judicious selection of four marker disks, as illustrated below, with reference to FIG. 5.

Figure 5:
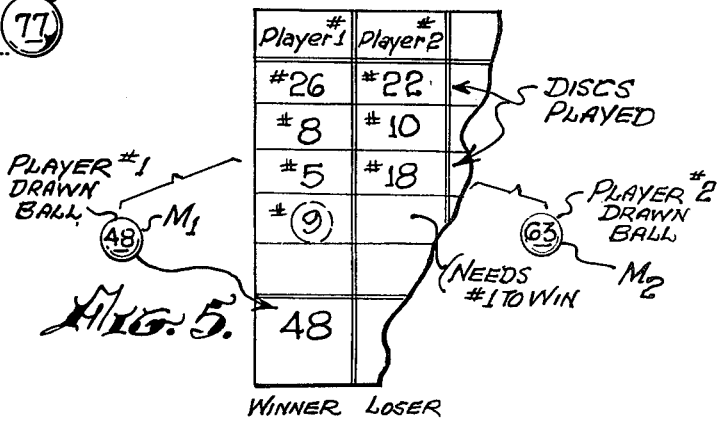

The partial view of FIG. 5 depicts a portion of a scoring sheet taken from a typical game between two players. Player 1 had scored first, by propelling disk $J_{28}$ into one of the pockets, as duly recorded in the example sheet. Player 2 had followed with a score of 22. In the next round Player 1 secured disk $J_8$, and his opponent $J_{10}$. Unbeknownst to each other, the players have also drawn marbles $M_1$ and $M_2$, respectively, with goal scores of 48 and 63.

Entering the third round of the game, Player 1 has a score of 34 points, as against a goal of 48, so that he could, theoretically, win the game by getting counter disk $J_{14}$ into a pocket. He does not succeed, and scores 5 points instead, for a new total of 39. Player No. 2 has only 32 points out of a desired 63 for a deficit of 31. He does not have even a theoretical chance to win on the third round and must secure the largest possible score (with the consideration that Player 1 had already played two counters, $J_{26}$ and $J_5$, whose combination is 31, which relieves Player 2 of the fear that he will play a high-valued counter whose complement is out of play, and secures $J_{18}$ for himself.

Player 1 is lucky, for he succeeds in pocketing counter $J_9$, and in bringing his score to the desired total of 48. Had he, accidentally, put one of the higher-valued counters into the pocket, he would have lost he game since his total would have exceeded that called for by marble $M_1$.

The rules may be elaborated further, but the basic principle of the game is clear, to achieve a randomly selected total goal score by pocketing the smallest possible number of counter disks J whose marked numerals add up to the preselected total. The rules may allow for 'subtractive play', where a player may continue to play after overshooting his goal, by attempting to secure for himself a counter which corresponds exactly to his excess; or they may be modified in other ways.

The game apparatus may also be changed in some respects, especially the order of the game table, the regular polygon which bounds it in the number of numeration of the counter disks, and in the numerals on the goal score markers or marbles. Such changes shall readily occur to one skilled in the art of constructing competitive game apparatus; as well as changes in the specific construction and arrangement of the game board and its support structure, pivoted or fixed.

All such deviations from the specifics of the disclosure are deemed encompassed by the invention, delimited solely by the appended claims.

The inventor claims:

1. Game apparatus, comprising:

a horizontal game board with a plurality of edges defining a regular polygon;

a number of circular counter disks, each marked with a different numeral, adapted to slide upon the surface of said game board;

a pocket at each corner of said game board, and depending therefrom for receiving said counter disks;

peripheral wall segments intermediate between said pockets, extending upwardly from the upper surface of said game board and concavely arcuate in plan view with respect to the geometric center thereof;

a circular puck, larger in diameter and mass than said counter disks;

at least one cue stick, adapted to impelling said puck into motion over the sufface of said game board, whereby said puck may be projected against one or more of said disks, to secure the entrapment of such counter disks in one or more of said pockets; and goal markers comprising fourteen marbles, each marble bearing a goal score number whereby each respective player draws a marble to predetermine his winning score mumber, the winning score number for each player being matched by the sum total of the numerals on said counter disc thus entrapped in said pockets by that player.

2. A game apparatus according to claim 1, wherein: said regular polygon is a square.

3. A game apparatus according to claim 2, and further comprising:

a game table with a central socket for receiving a central pin depending from said game board, to allow rotation thereof with respect to said game table.

4. A game apparatus according to claim 3, wherein: said counter disks number twenty-eight, and are severally marked with the numerals one through twenty-eight.

5. A game apparatus according to claim 1, wherein: said markers are marbles, fourteen in number.

6. A game apparatus according to claim 5, wherein: said marbles are each marked with one of the numerals: 48, 50, 52, 54, 57, 62, 63, 64, 66, 70, 72, 73, 75 and 77.

7. A game apparatus according to claim 2, wherein: said cue is provided with a resilient tip.

8. A game apparatus according to claim 1, wherein: said game board is provided with a central circular region demarcated by differential coloring.

9. A game apparatus according to claim 6, wherein: said square game board is provided with a central circular region demarcated by differential coloring.

* * * * *